US010408519B2

(12) United States Patent
Visin

(10) Patent No.: US 10,408,519 B2
(45) Date of Patent: Sep. 10, 2019

(54) METHOD TO EXTEND THE LIFE OF A TWIST ICE MAKER

(71) Applicant: WHIRLPOOL CORPORATION, Benton Harbor, MI (US)

(72) Inventor: Jerry Visin, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 60 days.

(21) Appl. No.: 15/409,174

(22) Filed: Jan. 18, 2017

(65) Prior Publication Data

US 2017/0122639 A1 May 4, 2017

Related U.S. Application Data

(63) Continuation of application No. 13/804,296, filed on Mar. 14, 2013, now Pat. No. 9,551,521.

(51) Int. Cl.

| | |
|---|---|
| ***F25C 1/24*** | (2018.01) |
| ***F25C 5/04*** | (2006.01) |
| ***F25C 5/06*** | (2006.01) |
| ***F25C 1/243*** | (2018.01) |

(52) U.S. Cl.

CPC ..... *F25C 1/243* (2013.01); *F25C 1/24* (2013.01); *F25C 5/04* (2013.01); *F25C 5/06* (2013.01); *F25C 2500/02* (2013.01)

(58) Field of Classification Search

CPC .... F25C 1/10; F25C 1/125; F25C 5/04; F25C 5/06; F25C 2305/022; F25C 1/24; F25C 1/243; F25C 5/185; F25C 2400/06; F25C 2700/06

USPC ..... 249/70, 137, 203; 99/426

See application file for complete search history.

(56) References Cited

U.S. PATENT DOCUMENTS

| | | | | |
|---|---|---|---|---|
| 2,203,892 | A | 6/1940 | Carney | |
| 2,415,451 | A | 2/1947 | Synnestvedt | |
| 2,941,377 | A | 6/1960 | Nelson | |
| 2,942,435 | A | 6/1960 | Nelson | |
| 3,033,008 | A | 5/1962 | Davis | |
| 3,371,905 | A | 3/1968 | Bunnell | |
| 3,620,497 | A | 11/1971 | Schaff | |
| 3,736,767 | A * | 6/1973 | Lukes | A23G 9/221 425/439 |
| 3,930,376 | A | 1/1976 | Schwartz | |
| 3,952,539 | A | 4/1976 | Hanson et al. | |
| 5,582,754 | A * | 12/1996 | Smith | F25C 1/24 219/386 |
| 7,093,816 | B2 | 8/2006 | Lacan et al. | |
| 7,097,626 | B2 | 8/2006 | Louis et al. | |

(Continued)

FOREIGN PATENT DOCUMENTS

| | | | |
|---|---|---|---|
| DE | 102010029143 | A1 | 12/2010 |
| JP | 9178310 | A | 7/1997 |

*Primary Examiner* — Cassey D Bauer

(74) *Attorney, Agent, or Firm* — Price Heneveld LLP

(57) ABSTRACT

An ice making apparatus for an appliance comprising an ice making tray having at least one specialty feature chosen from the group consisting of: a convex bottom surface, a ledge disposed about a perimeter of the at least one ice compartment and proximate a bottom portion of the at least one ice compartment, at least one thread extending from one corner of the at least one ice compartment to another corner of the at least one ice compartment, or any combination thereof.

20 Claims, 12 Drawing Sheets

(56) References Cited

U.S. PATENT DOCUMENTS

| | | | | |
|---|---|---|---|---|
| 2005/0151050 | A1* | 7/2005 | Godfrey | F25C 1/24 249/127 |
| 2010/0163707 | A1 | 7/2010 | Kim | |
| 2012/0023996 | A1 | 2/2012 | Herrera et al. | |
| 2012/0304676 | A1 | 12/2012 | White et al. | |

* cited by examiner

METHOD TO EXTEND THE LIFE OF A TWIST ICE MAKER

CROSS-REFERENCE TO RELATED APPLICATION

This application is a continuation of and claims priority to U.S. patent application Ser. No. 13/804,296, now U.S. Pat. No. 9,551,521, entitled "METHOD TO EXTEND THE LIFE OF A TWIST ICE MAKER," filed on Mar. 14, 2013, the entire disclosure of which is hereby incorporated herein by reference.

FIELD OF THE DISCLOSURE

The present disclosure generally relates to an appliance having an ice making apparatus and the method for constructing therefore.

BRIEF SUMMARY OF THE DISCLOSURE

The present disclosure provides an ice making tray with at least one specialty feature which ejects the ice from the tray sooner and more efficiently, reducing the amount of twist needed to eject the cube. Reducing the twist angle reduces the fatigue on the ice tray and increases the life of the ice tray.

An aspect of the present disclosure is generally directed towards an ice making apparatus for an appliance comprising a liquid inlet configured to receive water from a water source and an ice making tray. The ice making tray has at least one perimeter sidewall and a grid with at least one dividing wall. The ice making tray is configured to receive water from the inlet. The perimeter sidewall, dividing wall, and a bottom surface form at least one ice compartment. The at least one ice compartment is configured to produce at least one ice body and includes at least one specialty feature chosen from the group consisting of a convex bottom surface, a ledge disposed about a perimeter of the at least one ice compartment and proximate a bottom portion of the at least one ice compartment, or at least one thread extending from one corner of the at least one ice compartment to another corner of the at least one ice compartment.

Another aspect of the present disclosure is generally directed towards an appliance having an ice making apparatus comprising an ice making tray which has at least one perimeter sidewall and a grid with at least one dividing wall. The at least one perimeter sidewall and the at least one dividing wall along with a bottom surface form at least one ice compartment. The at least one ice compartment includes at least one specialty feature chosen from the group consisting of a convex bottom surface, a ledge disposed about a perimeter of the at least one ice compartment and proximate a bottom portion of the at least one ice compartment, or at least one thread extending from one corner of the at least one ice compartment to another corner of the at least one ice compartment.

Yet another aspect of the present disclosure is generally directed towards a method for producing an ice body from an appliance. The first step is providing a liquid inlet configured to receive water from the water source and an ice making tray having at least one perimeter sidewall in a grid with at least one dividing wall. The at least one perimeter sidewall and the at least one dividing wall, along with a bottom surface form at least one ice compartment. Next, water is received from the liquid inlet into the at least one ice compartment. The water is then frozen to produce at least one ice body. Finally, the ice is harvested from the at least one ice compartment. The at least one ice compartment includes at least one specialty feature chosen from the group of a convex bottom surface of the at least one ice compartment, a ledge disposed on a bottom half of the at least one ice compartment, or at least one thread extending from one corner from the at least one ice compartment to an opposite corner of the at least one ice compartment.

These and other features, advantages, and objects of the present disclosure will be further understood and appreciated by those skilled in the art by reference to the following specification, claims, and appended drawings.

DETAILED DESCRIPTION

Before the subject disclosure is described further, it is to be understood that the disclosure is not limited to the particular embodiments of the disclosure described below, as variations of the particular embodiments may be made and still fall within the scope of the appended claims. It is also to be understood that the terminology employed is for the purpose of describing particular embodiments, and is not intended to be limiting. Instead, the scope of the present disclosure will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the disclosure. The upper and lower limits of these smaller ranges may independently be included in the smaller ranges, and are also encompassed within the disclosure, subject to any specifically excluded limit in the stated range. Where the stated range includes one or both of the limits, ranges excluding either or both of those included limits are also included in the disclosure.

In this specification and the appended claims, the singular forms "a," "an" and "the" include plural reference unless the context clearly dictates otherwise.

Figure 1:
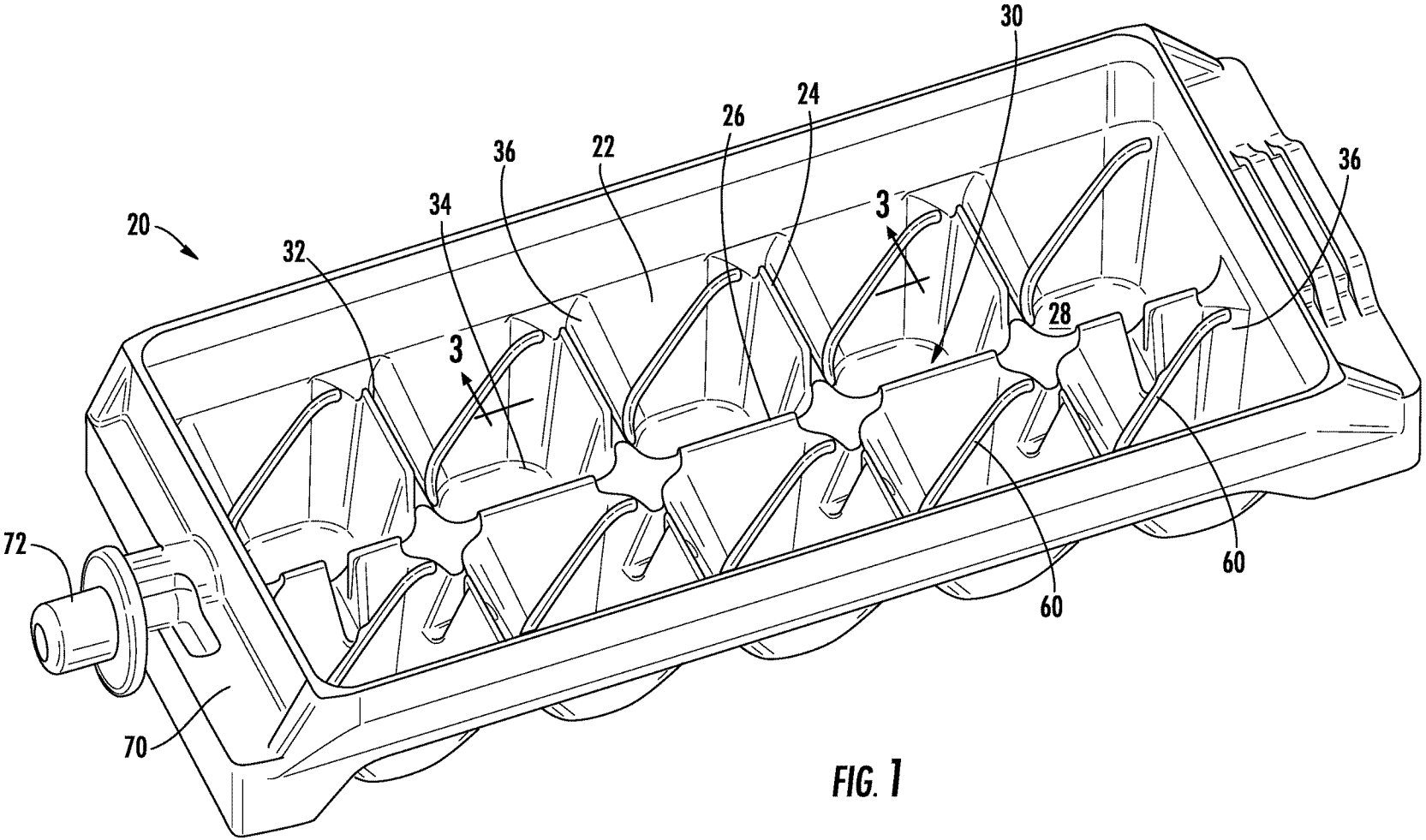
FIG. 1 is a top perspective view of one embodiment of the present disclosure.

As shown in FIG. 1, reference number 20 generally designates an ice making tray. The ice making tray 20 is generally comprised of at least one perimeter sidewall 22 and a grid 24 having at least one dividing wall 26 and is typically comprised of a plastic polymer. The at least one perimeter sidewall 22 and the at least one dividing wall 26 along with a bottom surface 28 form at least one ice compartment 30. The at least one ice compartment 30 includes at least one specialty feature chosen from the group consisting of: a convex bottom surface 40, a ledge 50 disposed about a perimeter 32 of the at least one ice compartment 30 and proximate a bottom portion 34 of the at least one ice compartment 30, or at least one thread 60 extending from at least one corner 36 of the at least one ice compartment 30 to another corner 36 of the at least one ice compartment 30. FIG. 1 shows a plurality of threads 60 extending from an upper corner 36 of the ice compartment 30 to a lower corner 36 on the same sidewall 22.

Figure 2:
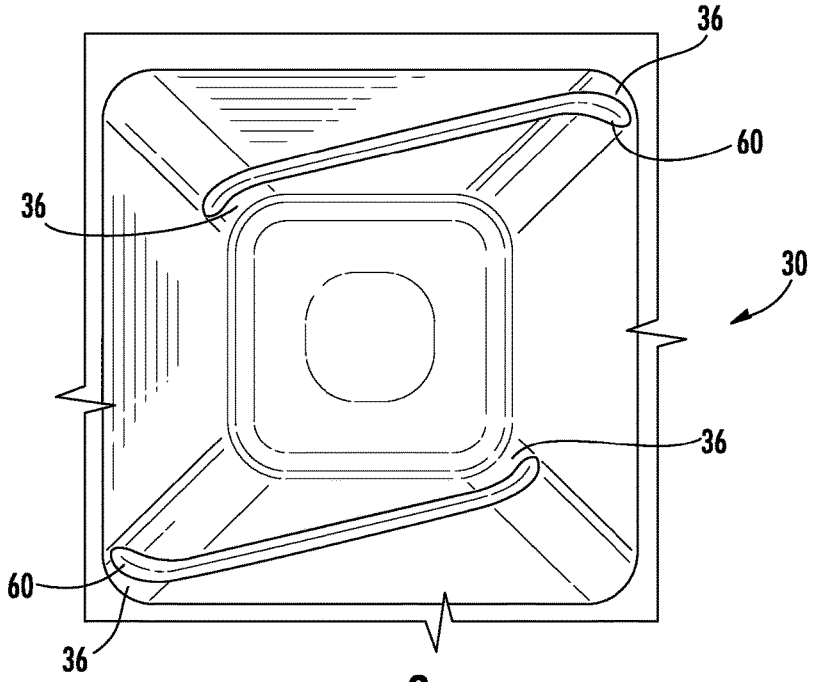
FIG. 2 is a top plan view of an ice compartment of FIG. 1.
Figure 3:
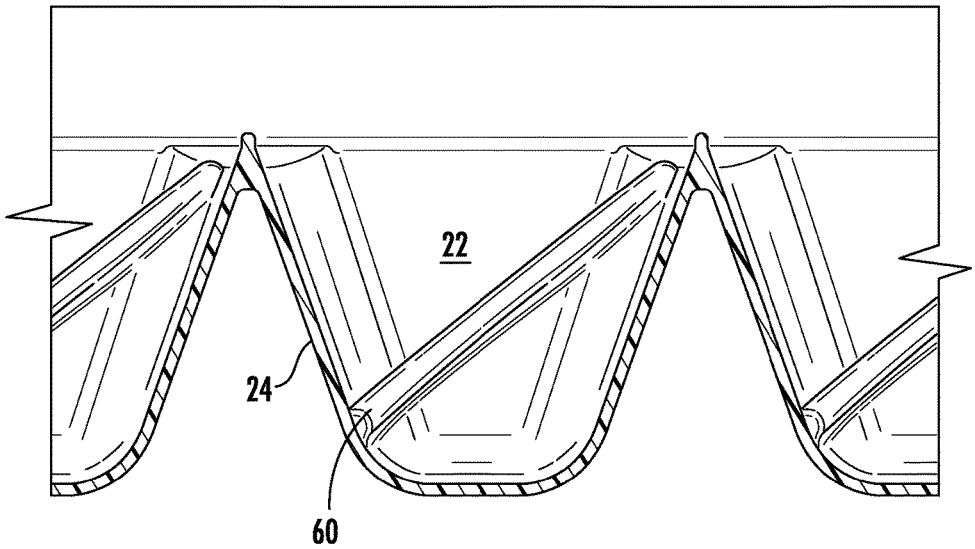
FIG. 3 is a cross sectional view of the embodiment shown in FIG. 1.
Figure 4:
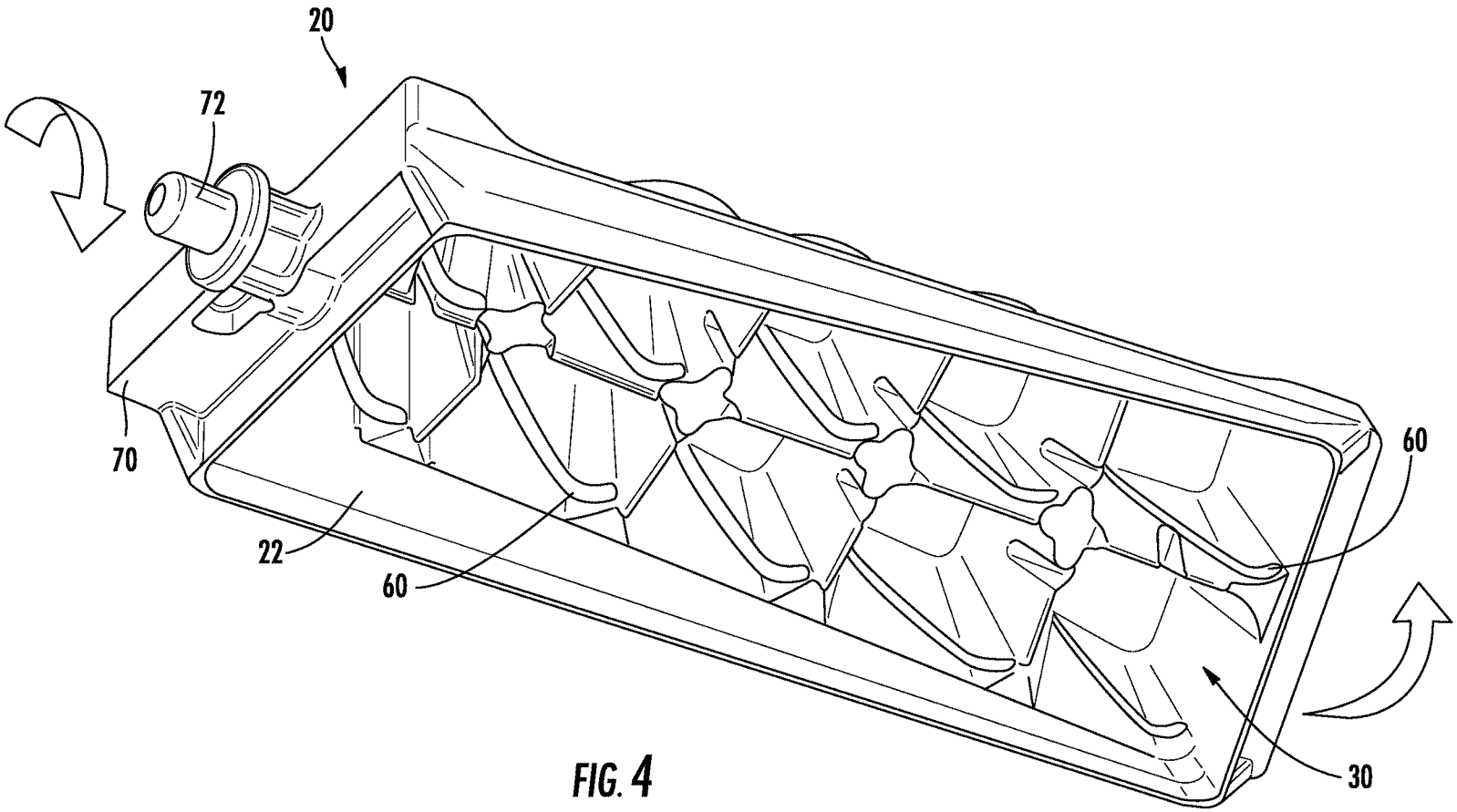
FIG. 4 is a bottom perspective view of the embodiment shown in FIG. 1.

FIG. 2 shows the inside of the ice compartment 30. Further, FIG. 2 shows the (typically a twistingly-shaped) thread 60 extending from one corner 36 to another corner 36, preferably from an upper corner 36 to a lower corner 36 and most preferably from an upper corner 36 to a bottom corner 36 on the same sidewall 22. Moreover, a plurality of threads 60 may be disposed in a plurality of corners 36 of the ice compartment 30. The thread 60 is typically an elongated cylindrical shape having curved edges, and typically is comprised of a polymeric material, typically the same polymeric material which comprises the ice making tray 20. During the harvesting process, the thread 60 assists the harvesting of the ice body and also decreases the rotational angle needed during the twisting harvesting motion. During the harvesting process, the thread 60 acts like a ramp to break free the ice body from the ice compartment 30. The thread 60 can be oriented on all sides of the ice compartment 30. Further, as shown in FIG. 4, the threads 60 are preferably oriented in the opposite direction of the twist. FIG. 3 is a cross-sectional view of the ice compartment 30 showing the thread 60 extending from one corner to an opposite corner. FIG. 4 shows the direction of twist of the ice making tray 20 during the harvesting process.

Figure 5:
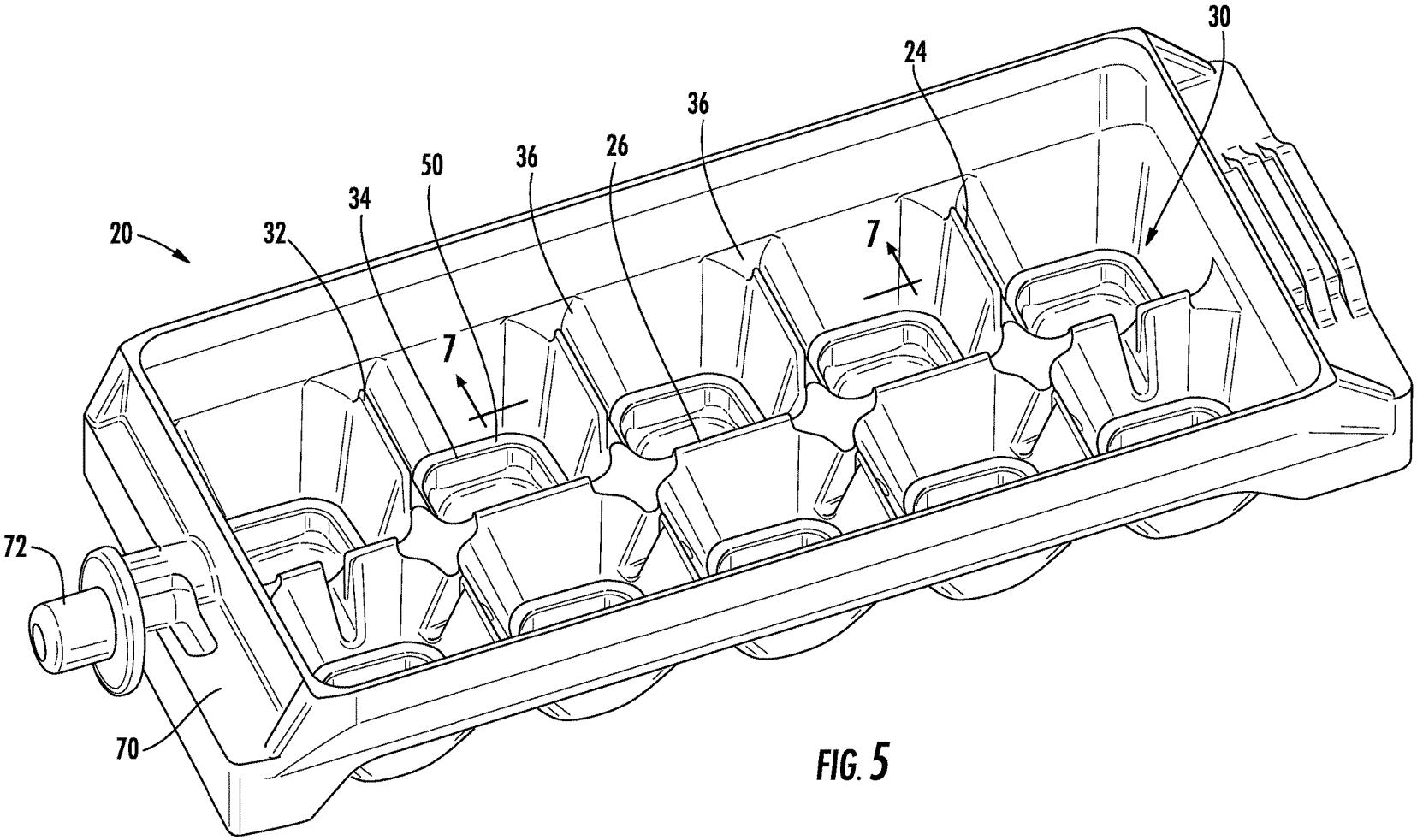
FIG. 5 is a top perspective view of one embodiment of the present disclosure.
Figure 6:
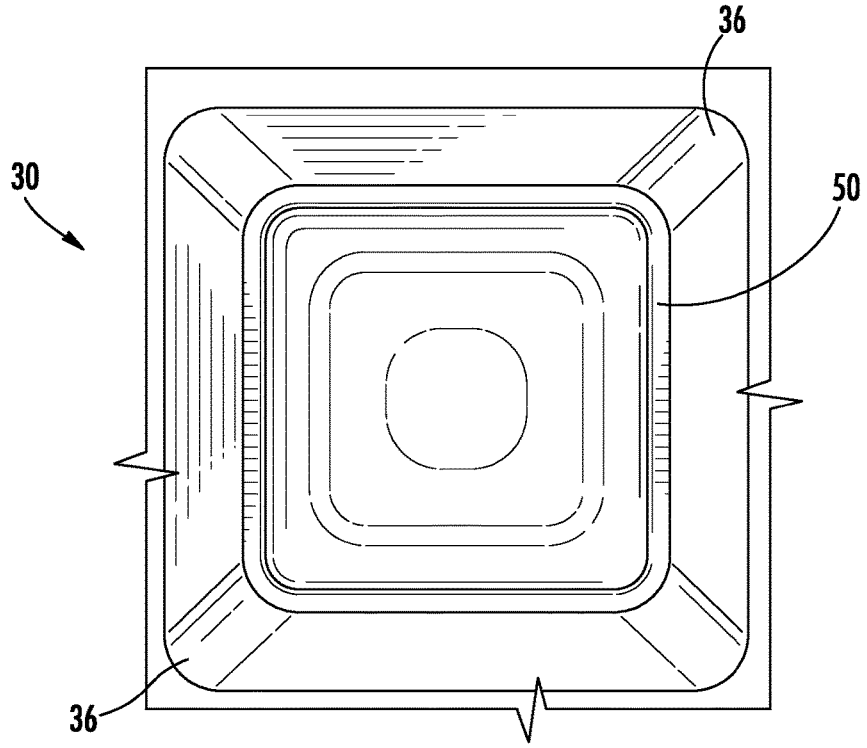
FIG. 6 is a top plan view of the ice compartment of FIG. 5.
Figure 7:
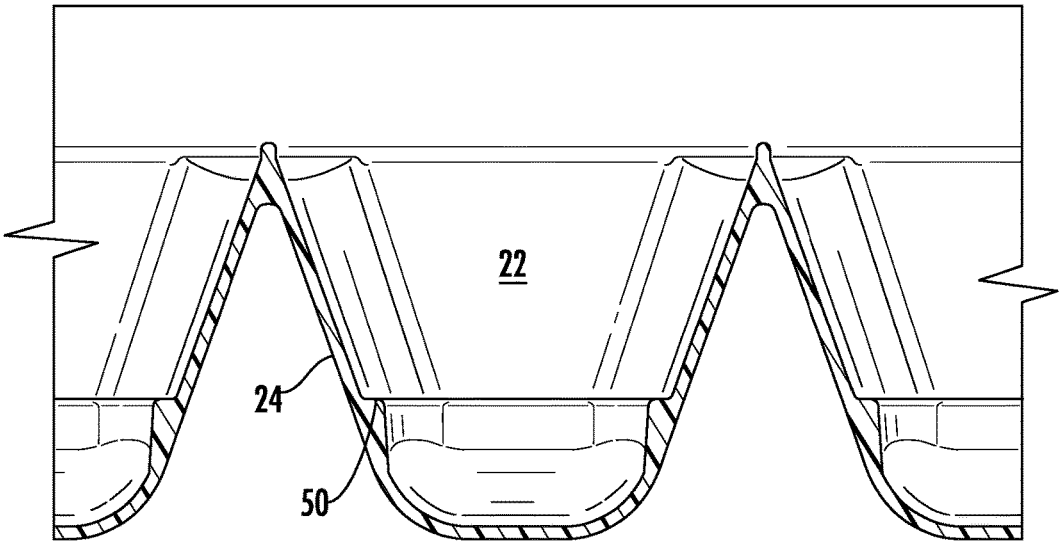
FIG. 7 is a cross sectional view of the embodiment shown in FIG. 5.
Figure 8:
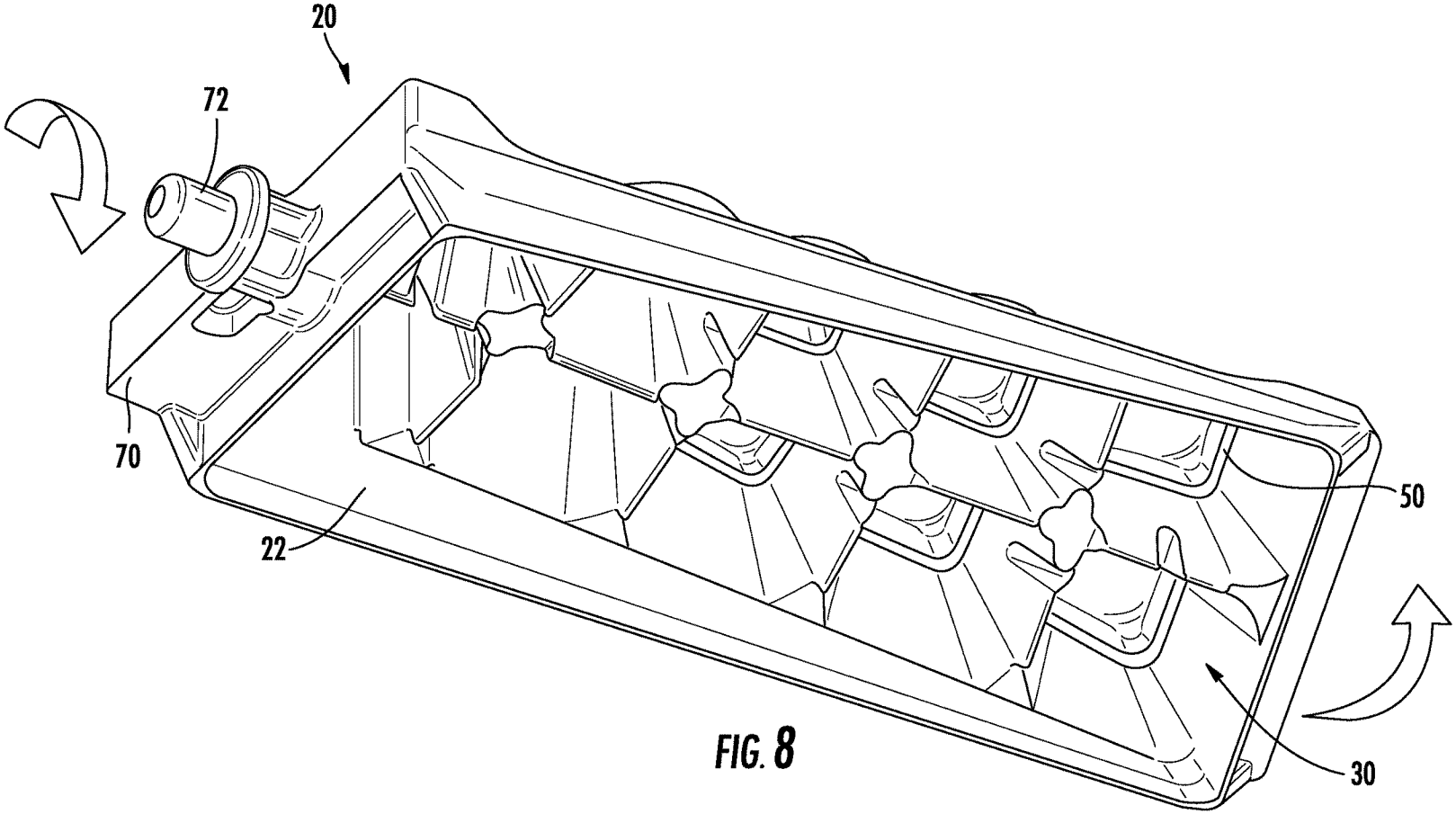
FIG. 8 is a bottom perspective view of the embodiment shown in FIG. 5.

FIG. 5 shows another embodiment of the ice making tray 20 having a ledge 50 disposed proximate a bottom portion 28 of and disposed about the perimeter 32 of the at least one ice compartment 30. The ledge 50 is typically comprised of the same plastic polymer material as the ice making tray 20. The ledge 50 may be formed integrally with the ice making tray 20 in a plastic mold, or may be added to the bottom portion 34 of the ice compartment 30 at any other time. The ice compartment 30 is typically configured to be 1" wide by 1" in length and approximately ⅝" in height. Typically, the ledge 50 has an approximate width of ⅛" and an approximate height of ¼". However, the ledge 50 may also be of any desirable width and height according to the present disclosure to assist ice in ejection from the at least one ice compartment 30. During harvesting, the ledge 50 is configured to help eject the ice body 38 from the ice compartment 30 while minimizing the twist angle of the tray 20 required to eject the ice body 38. FIGS. 6-8 show alternate views of the ice making compartment 30 containing a ledge 50.

Figure 9:
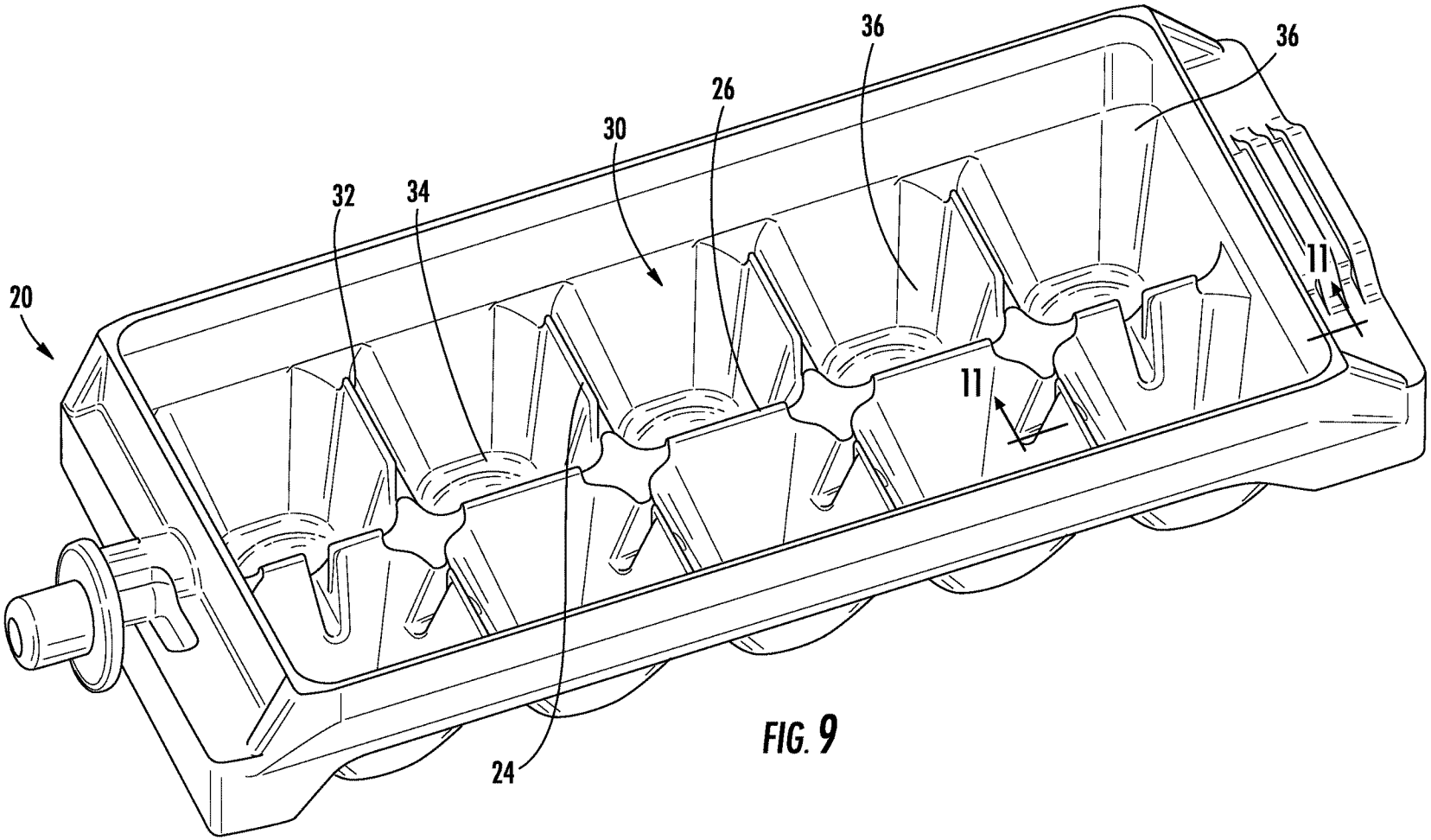
FIG. 9 is a top perspective view of one embodiment of the present disclosure.
Figure 10:
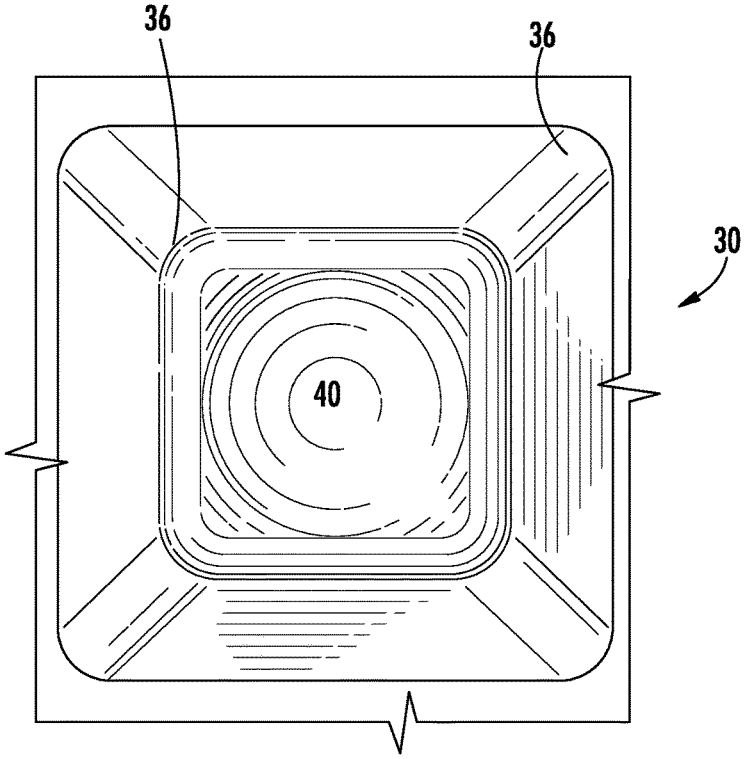
FIG. 10 is a top plan view of the ice compartment of the embodiment shown in FIG. 9.
Figure 11:
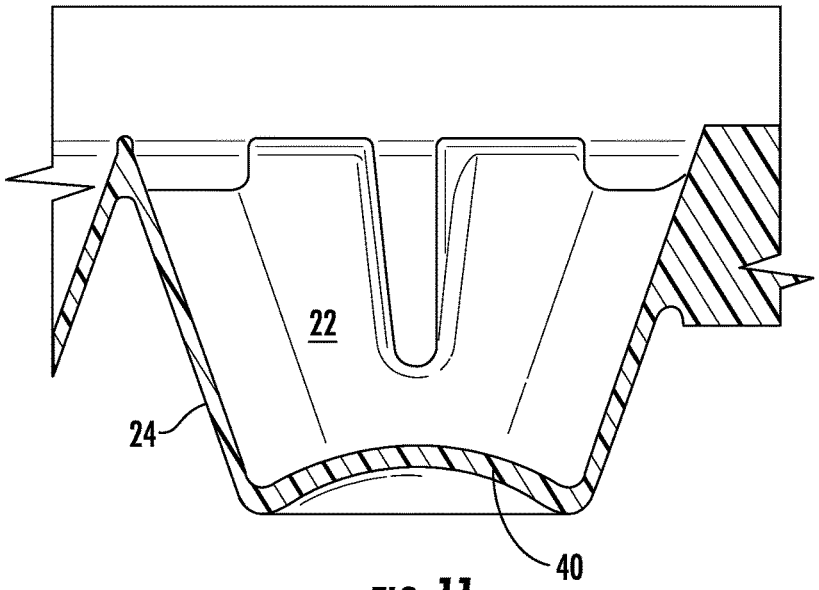
FIG. 11 is a cross sectional view of the embodiment shown in FIG. 9.
Figure 12:
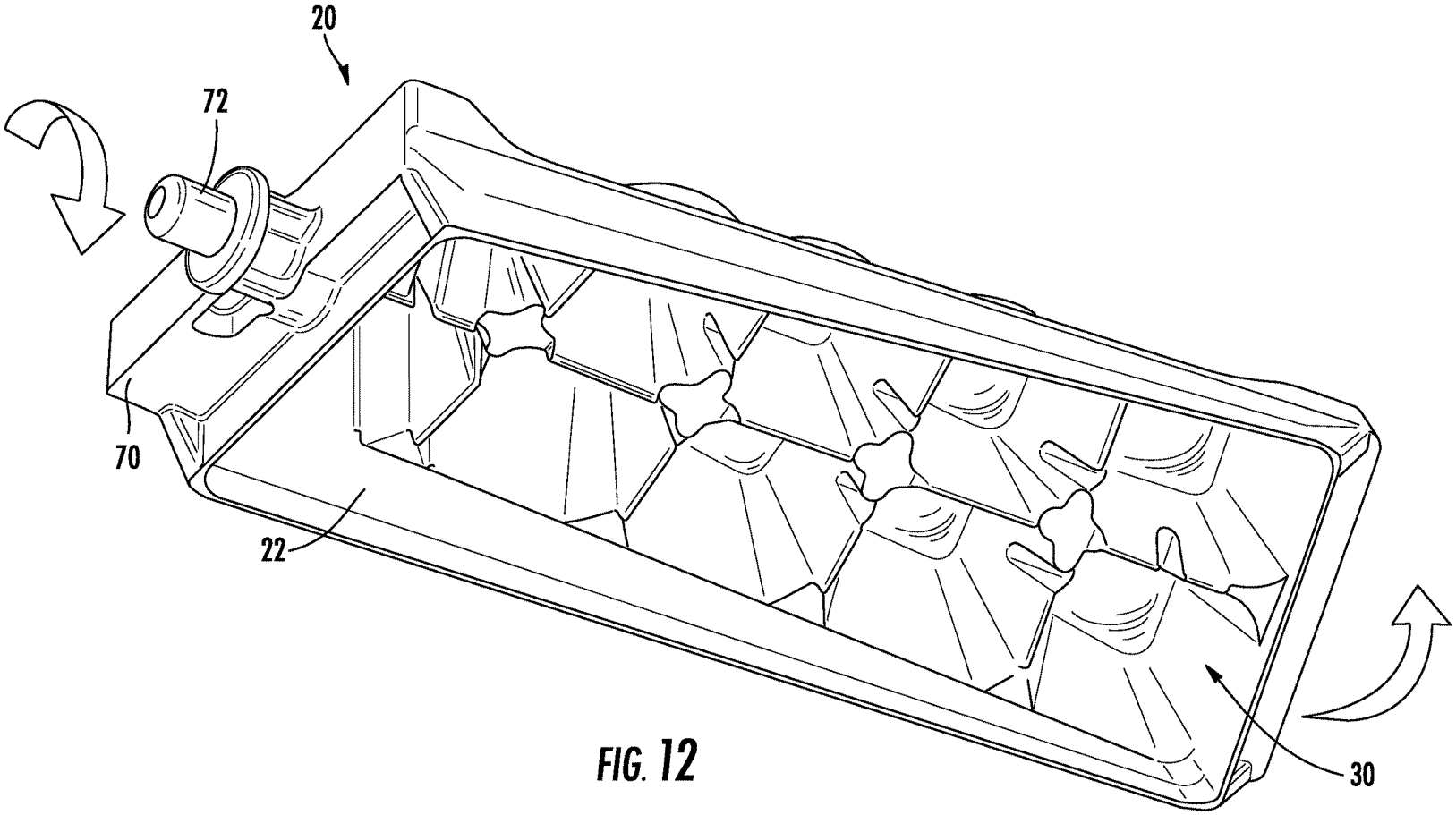
FIG. 12 is a bottom perspective view of the embodiment shown in FIG. 9.
Figure 13:
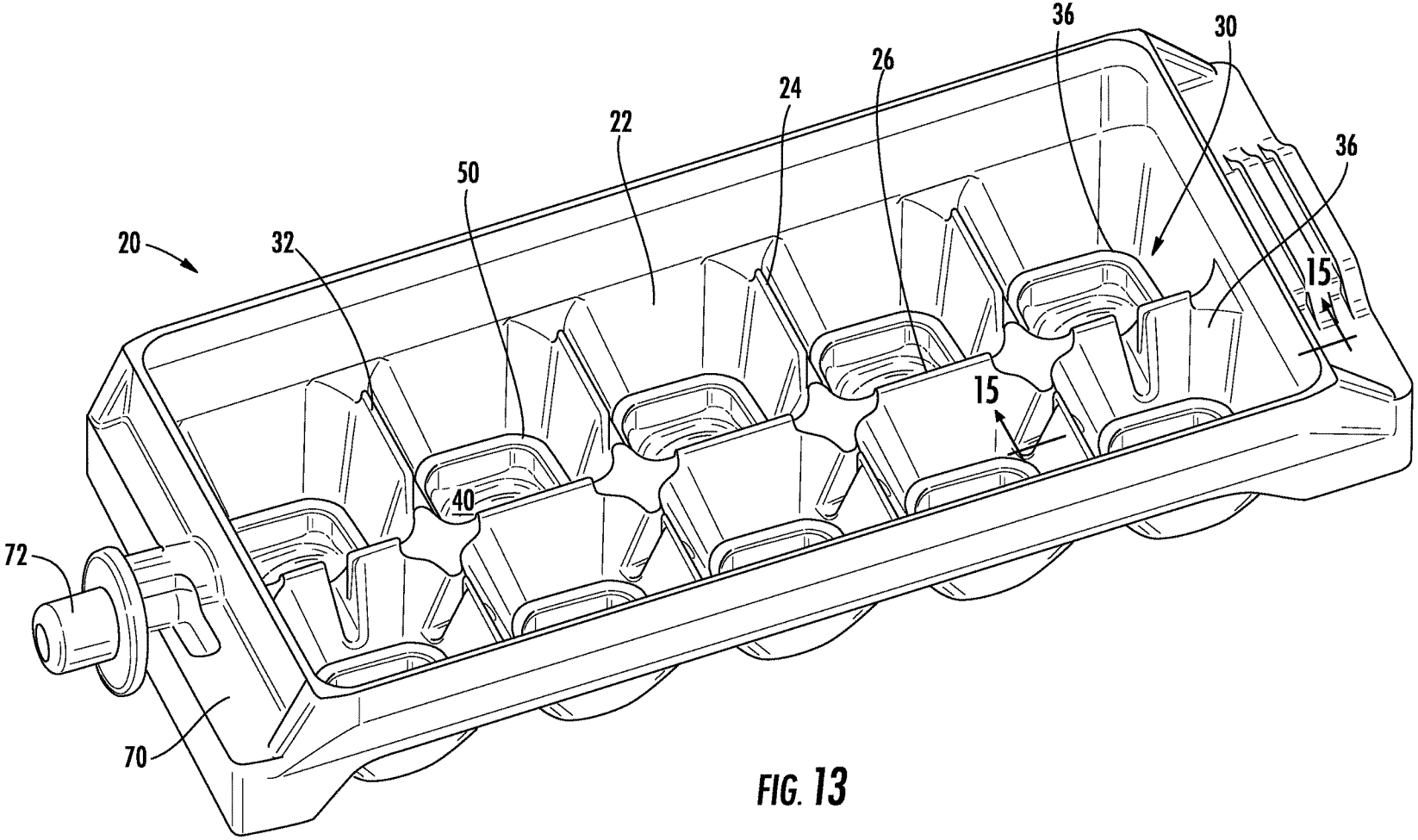
FIG. 13 is a top perspective view of one embodiment of the present disclosure.
Figure 14:
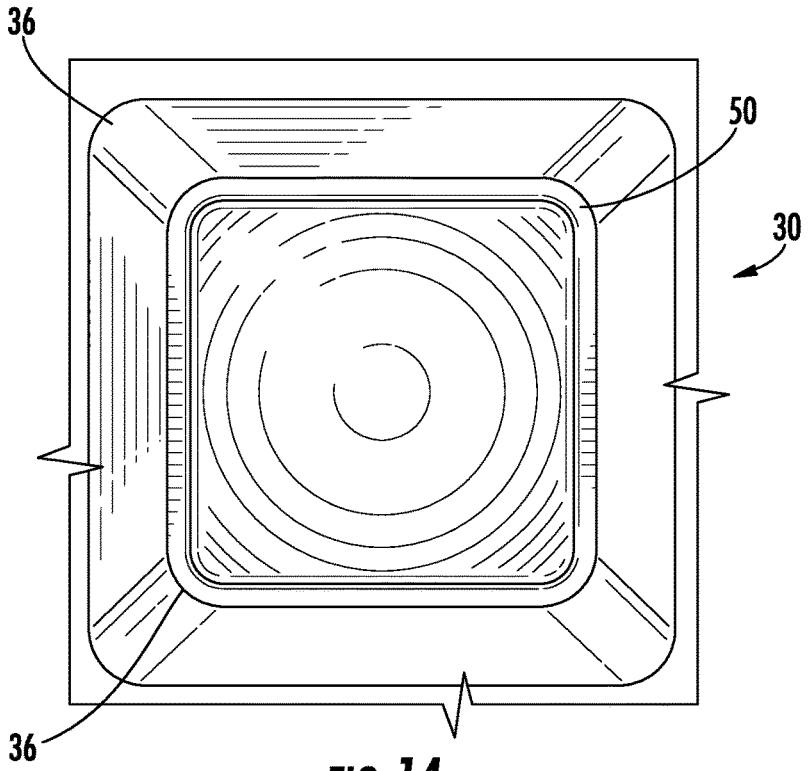
FIG. 14 is a top plan view of the ice compartment of the embodiment shown in FIG. 13.
Figure 15:
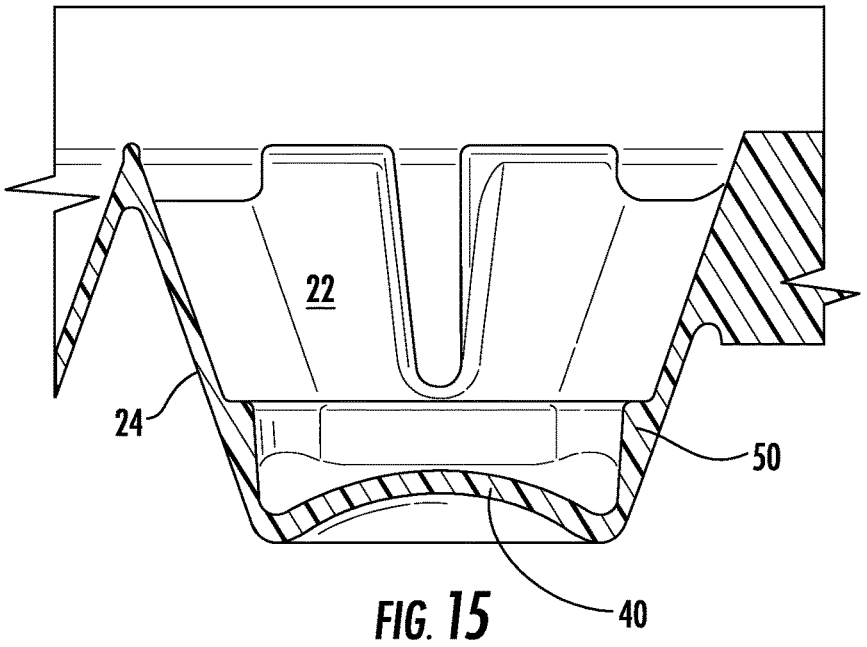
FIG. 15 is a cross sectional view of the embodiment shown in FIG. 13.
Figure 16:
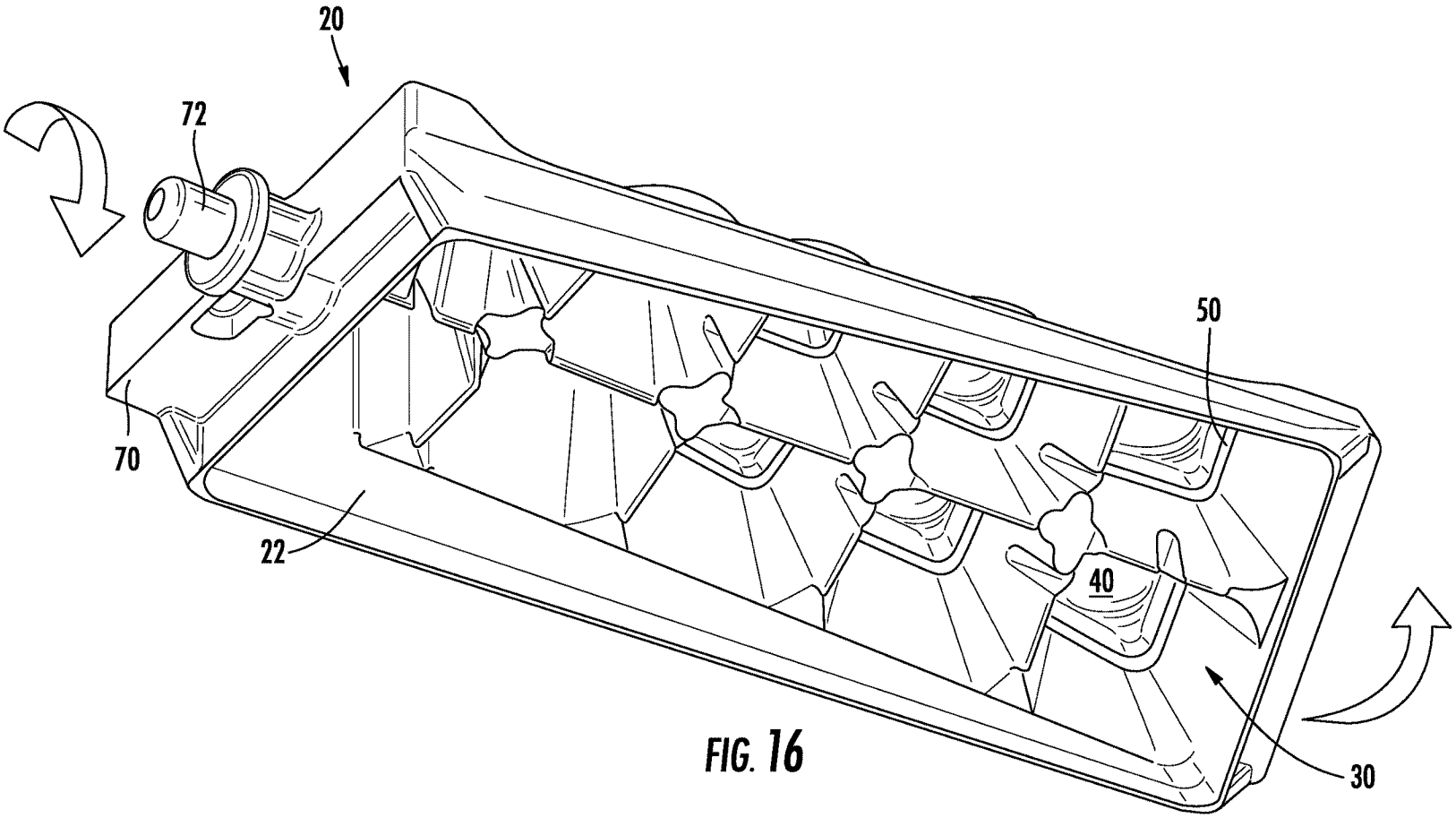
FIG. 16 is a bottom perspective view of the embodiment shown in FIG. 13.

FIG. 9 shows another embodiment of the ice making tray 20 of the present disclosure. The ice making tray 20 as shown in FIGS. 9-12, includes a specialty feature wherein the bottom surface 28 of the at least one ice compartment 30 is a convex bottom surface 40. The convex bottom surface is typically integral with the ice compartment 30. Typically, the convex angle of the convex bottom surface 40 of the ice compartment 30 is approximately 15°-35° but also may encompass additional angles according to the present disclosure. The convex bottom surface 40 is configured to assist the ice body 38 during the harvesting process. During the twisting motion of the ice tray 20, the convex bottom surface 40 acts as an ejector of sorts to help remove the ice body 38 from the ice compartment 30.

As shown in FIGS. 13-16, the ice making tray 20 may include a plurality of specialty features including various combinations of these discussed herein. The specialty features may be chosen from the group consisting of: a convex bottom surface 40, a ledge 50 disposed about a perimeter of the at least one ice compartment 30 and proximate the bottom portion 34 of the at least one ice compartment 30, or at least one thread 60 extending from one corner 36 of the at least one ice compartment 30 to another corner 36 of the at least one ice compartment 30. Any combination of the specialty features may be included in the ice making tray 20. Specifically, the ice making tray 20 may include one, two, or all three specialty features in a single ice compartment 30. Additionally, each ice compartment 30 on a single ice tray 20 may include the same combination, or a different combination of specialty features. The embodiment shown in FIGS. 14 and 15 includes a convex bottom surface 40 and the ledge 50. This embodiment is for illustrative purposes only and is not meant to show every possible embodiment of the ice making tray 20.

In operation, the ice making apparatus 10 is configured to receive water into the ice making tray 20 and specifically into the at least one ice compartment 30. The water is then frozen using any conventionally known method such as an evaporator or any other heat removing device. Once the ice is formed in the ice compartment 30, the ice tray 20 is twisted approximately 180° in a twisting direction (see FIGS. 4, 8, 12, 16) until one end of the ice making tray 20 which includes a stopper 70 engages a stopping surface (not shown). The opposite end of the ice making tray 20 further twists while the stopper 70 is engaged to the stopping surface which further twists the ice tray 20 and ejects the ice from the ice compartment 30. The specialty features of the ice making tray 20 including the convex bottom surface 40, the ledge 50, and the threads 60 are configured to reduce the amount of twist needed by the ice tray 20 in order to harvest the ice bodies 38 from the ice compartment 30. By reducing the amount of twist, the stress applied to the material of the ice making tray 20 is also reduced which increases the life of the ice tray 20. The ice making tray 20 of the present disclosure allows the ice bodies 38 to be removed from the ice compartment 30 sooner and more efficiently than prior art twisting ice makers.

Those skilled in the art with recognize, or be able to ascertain using no more than routine experimentation, many equivalents to the specific embodiments of the disclosure described herein. Such equivalents are intended to be encompassed by the following claims.

What is claimed is:

1. An ice making apparatus for an appliance comprising:
an ice making tray configured to receive water from an inlet and having at least one perimeter sidewall and a grid with at least one dividing wall that define a plurality of ice compartments, wherein each of the plurality of ice compartments includes a rigid, convex bottom surface extending at least partially into the respective ice compartment and at least one of:
a ledge disposed about a perimeter of each of the plurality of ice compartments, wherein at least one ledge traverses a portion of the at least one perimeter sidewall of the respective ice compartment and is proximate a bottom portion of the respective ice compartment; and
at least one thread extending from one corner of one of the plurality of ice compartments to another corner of one of the plurality of ice compartments.

2. The ice making apparatus of claim 1, wherein the at least one thread of each of the plurality of ice compartments includes two distinct and opposing threads.

3. The ice making apparatus of claim 2, wherein one of the distinct threads is disposed on the perimeter sidewall and the other of the distinct threads is disposed on the dividing wall.

4. The ice making apparatus of claim 1, wherein the at least one thread extends from one corner of one of the plurality of ice compartments to another corner of one of the plurality of ice compartments.

5. The ice making apparatus of claim 1, wherein one or more of the plurality of ice compartments includes a flow channel through which water flows to an adjacent ice compartment.

6. The ice making apparatus of claim 2, wherein each of the distinct and opposing threads is configured to extend from a top corner of one of the plurality of ice compartments to a bottom corner of one of the plurality of ice compartments.

7. The ice making apparatus of claim 1, wherein at least one ice body is harvested from the plurality of ice compartments by twisting the ice making tray.

8. The ice making apparatus of claim 7, wherein the at least one thread is orientated in an opposite direction of the twist.

9. The ice making apparatus of claim 1, wherein the ledge is integrally formed with the perimeter sidewall and the dividing wall.

10. The ice making apparatus of claim 1, wherein the ledge minimizes a twist angle of the tray required to eject ice formed in the plurality of ice compartments.

11. An ice making apparatus for an appliance comprising:
an ice making tray having a perimeter sidewall and a dividing wall that define a plurality of ice compartments, wherein each of the plurality of ice compartments includes at least one thread extending from one corner of one of the plurality of ice compartments to another corner of one of the plurality of ice compartments and at least one of:
a convex bottom surface extending at least partially into the respective ice compartments; and
a ledge disposed about a perimeter of each of the plurality of ice compartments, wherein at least one ledge traverses a portion of the perimeter sidewall of a respective ice compartment of the plurality of ice compartments and is proximate a bottom portion of the respective ice compartment.

12. The ice making apparatus of claim 11, wherein the at least one thread of each of the plurality of ice compartments includes two distinct and opposing threads.

13. The ice making apparatus of claim 12, wherein one of the distinct and opposing threads is disposed on the sidewall and the other of the distinct threads is disposed on the dividing wall.

14. The ice making apparatus of claim 11, wherein the at least one thread extends from one corner of one of the plurality of ice compartments to another corner of one of the plurality of ice compartments.

15. The ice making apparatus of claim 11, wherein one or more of the plurality of ice compartments includes a flow channel through which water flows to an adjacent ice compartment.

16. The ice making apparatus of claim 12, wherein each of the distinct threads is configured to extend from a top corner of one of the plurality of ice compartments to a bottom corner of one of the plurality of ice compartments.

17. The ice making apparatus of claim 11, wherein at least one ice body is harvested from the plurality of ice compartments by twisting the ice making tray in a first direction.

18. The ice making apparatus of claim 17, wherein the at least one thread is orientated in a second direction that is opposite the first direction.

19. The ice making apparatus of claim 11, wherein the ledge is integrally formed with the perimeter sidewall and the dividing wall.

20. The ice making apparatus of claim 11, wherein the ledge minimizes a twist angle of the tray required to eject ice formed in the plurality of ice compartments.

* * * * *